United States Patent [19]

Lederich et al.

[11] 4,415,375

[45] Nov. 15, 1983

[54] TRANSIENT TITANIUM ALLOYS

[75] Inventors: Richard J. Lederich, University City; Shankar M. Sastry, St. Louis, both of Mo.

[73] Assignee: McDonnell Douglas Corporation, St. Louis, Mo.

[21] Appl. No.: 387,153

[22] Filed: Jun. 10, 1982

[51] Int. Cl.[3] ..... C22F 1/18

[52] U.S. Cl. ..... 148/11.5 F; 148/133; 148/421

[58] Field of Search ..... 148/11.5 F, 133, 421

[56] References Cited

U.S. PATENT DOCUMENTS 2,892,742 6/1959 Zwicker et al. ..... 148/11.5 F

OTHER PUBLICATIONS

Kolachov et al., "The Influence of Hydrogen on Hot Deformability of Titanium Alloys with Different Phase Compositions," *Titanium and Titanium Alloys,* vol. 3, Plenum Press, 1982, pp. 1833–1842.

Jovane, "Superplasticity in Titanium", *The Science, Technology, and Application of Titanium,* Pergammon Press, N.Y., 1970, pp. 615–623.

*Primary Examiner*—Peter K. Skiff

*Attorney, Agent, or Firm*—Rogers, Eilers & Howell

[57] ABSTRACT

Transient titanium alloys having the composition A-XH, where A is titanium or a titanium alloy, such as, Ti-8Al-1Mo-1V, Ti-5Al-2.5Sn, Ti-6Al-4V, or Ti-6Al-2Sn-4Zr-2Mo; where H represents hydrogen and where X is a weight percent value between about 0.01 and 0.5%. The alloys may be produced by heating the base titanium or titanium alloy under pressure in a non-flammable atmosphere containing hydrogen. The alloys containing hydrogen may be formed by superplastic forming techniques. After forming, the original titanium or titanium alloy can be restored by heating the formed part or structure, under vacuum, driving out the hydrogen from the alloy. Parts and structures formed from the transient alloy, and restored, retain the strength and structural integrity of the base alloy.

21 Claims, 10 Drawing Figures

EFFECT OF INTERNAL HYDROGEN ON SPF OF Ti-6Al-4V AT 860°C AND 18.8 MPa (2.72 ksi).

EFFECT OF INTERNAL HYDROGEN ON SPF OF Ti-6Al-4V AT 800°C AND 18.8 MPa (2.72 ksi).

EFFECT OF INTERNAL HYDROGEN ON SPF OF Ti-6Al-4V AT 760°C AND 18.8 MPa (2.72 ksi).

EFFECT OF INTERNAL HYDROGEN ON SPF OF Ti-6Al-2Sn-4Zr-2Mo AT 900°C AND 18.8 MPa (2.72 ksi).

EFFECT OF INTERNAL HYDROGEN ON SPF OF Ti-6Al-2Sn-4Zr-2Mo AT 830°C AND 18.8 MPa (2.72 ksi).

EFFECT OF INTERNAL HYDROGEN ON SPF OF Ti-6Al-2Sn-4Zr-2Mo AT 800°C AND 18.8 MPa (2.72 ksi).

TRANSIENT TITANIUM ALLOYS

BACKGROUND AND SUMMARY OF THE INVENTION

The U.S. Government has rights to this invention pursuant to Contract No. F33615-80-C-5118 awarded by the Department of the Air Force.

Titanium and titanium alloys are extremely valuable in uses where light weight and high strength to weight ratio are important. The aircraft industry and other transportation industries in particular find such alloys highly useful. In order to fully take advantage of the strength and weight properties of titanium, it is often desirable to utilize superplastic forming techniques, e.g., to form titanium and titanium alloys in complex parts. Complex parts are parts having a shape of such complexity that they cannot be readily formed by standard casting, molding, forging, machining and welding techniques.

Superplastic forming typically is used to form sheet stock of between about 0.040 to 3/16 inch thickness. In superplastic forming, a die having the desired shape is used. A piece of stock of titanium alloy, such as a sheet of the alloy, is introduced into the die. The part is normally heated in the die. In the die, the pressure on one side of the stock is reduced and the pressure on the other side of the stock is increased, for example, to between about 200–300 psi. The difference in pressure forces the stock to flow into the die and assume the desired shape conforming to the die.

This method of forming allows complex shaped, formed parts to be manufactured which can take advantage of the high strength to weight ratios inherent in titanium alloys. However, there are limitations in this fabrication method. In general, the superplastic method is not suitable for use with unalloyed titanium and certain high temperature titanium alloys (the near alpha alloys and the like). To adequately superplastically form titanium alloys into useful parts, it is necessary for the stock to have a microstructure which contains alpha and beta phases and a fine grain size (below about 10 microns). This severely restricts the alloys which may be formed by the superplastic technique. Unalloyed titanium, for example, cannot be superplastically formed, since it has no beta phase. In addition, some titanium alloys can be formed by superplastic methods, but only at a temperature above that at which the grain structure of the alloy grows to an unacceptable size. For example, Ti-8Al-1Mo-1V can only be superplastically formed at a temperature of about 900°–975° C. or above. At that temperature, the grain size of the alloy rapidly grows to above 10 microns, and as a result, the formed part has an unacceptably low strength.

At present only Ti-6Al-4V alloy can be successfully formed by superplastic techniques. Even Ti-6Al-4V requires a forming temperature of 875° C. or more. This temperature is sufficiently high that a high rate of die wear, and replacement expense, is experienced. In addition, the production rate is slow adding greatly to the cost of the formed parts. Due to these factors, parts formed of titanium and titanium alloys must often be fabricated by more costly conventional techniques, or with high die wear, at such slow rates, in order to retain the mechanical properties of the formed parts, that superplastic forming is not practicable. Often the reduced strength caused by the unsuitable structural properties of the formed parts requires that additional material be used to make the formed part, losing the inherent strength to weight value of titanium and titanium alloys.

Applicants have found that titanium and titanium alloys, including the high temperature (near alpha and the like titanium alloys), may be formed into alloy parts and structures of extremely complex shapes much more economically than previously possible using superplastic forming techniques. Applicants have found that titanium and titanium alloys may be formed into transient alloys which are much more suitable to superplastic forming. The transient alloys allow superplastic forming to occur at much lower temperatures and to proceed much more rapidly. Even alloys which can be successfully worked by superplastic forming can greatly benefit from applicants' invention. For example, Ti-6Al-4V can be formed by prior techniques using a forming temperature of about 875° C. Using applicants' invention, parts can be produced from this alloy, as temporarily modified, at temperatures of about 800° C. At this temperature the die wear and overall cost of production of parts so formed are significantly reduced. Formation of undesirable microstructures in the alloys is negligible so that the mechanical properties of the alloys and of parts formed from the alloys are not degraded.

After formation of parts from the transient alloys, the titanium and titanium alloys can be returned to their original composition, resulting in extremely light weight and strong titanium and titanium alloy parts. The superplastic parts formed may be produced at higher production rates, at low cost and from compositions which in the past would not have allowed this technique to have been used.

The invention will be more apparent from the following detailed description of the preferred embodiments and the drawings:

DESCRIPTION OF THE PREFERRED EMBODIMENTS

Figure 1:
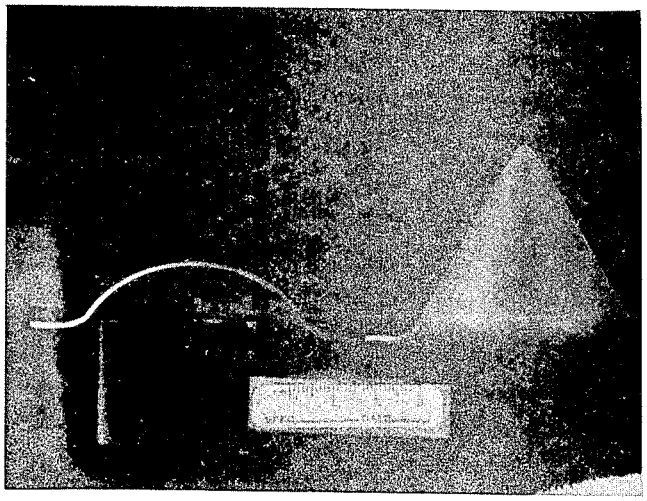
FIG. 1 is a comparison of a Ti-8Al-1Mo-1V conventional alloy superplastically formed in a cone die and applicants' Ti-8Al-1Mo-1V-0.2H transient alloy superplastically formed in a cone die.

Applicants' transient alloys are formed principally of titanium. By "titanium" we mean both unalloyed titanium and titanium alloys. The invention is especially valuable for unalloyed titanium and high temperature titanium alloys (such as the near alpha alloys and the like), which in some instances may not be superplastically formed without transient alloy formation. However, other titanium alloys may be used. Examples of titanium alloys from which transient alloys may be formed are Ti-8Al-1Mo-1V, Ti-5-Al-2-2.5Sn, Ti-6Al-4V, and Ti-6Al-2Sn-4Zr-2Mo. Transient alloys are prepared, for example, from the above alloys, by the addition of hydrogen into the alloy matrix. The amount of hydrogen added is not critical. One should, however, avoid hydrogen addition in such large quantities as to change the alloys to single beta phase. Hydrogen introduced into the alloy matrix at a level between about 0.01 and 0.5 weight percent of the total matrix is effective to improve forming. Normally above 0.2 percent is optimum. The transient alloys may be described by the general formula A—XH, where A is the base alloy material, including unalloyed titanium, H is hydrogen and X is a numerical value normally between about 0.01 and 0.5 percent by weight.

The transient alloys are formed from the base alloy stock, that is, from unalloyed titanium or from a titanium alloy, by heating the stock under pressure in a non-flammable gas environment for a time sufficient for hydrogen to be absorbed and dissolved into the alloy matrix. A typical composition for the non-flammable gas environment would be a gas consisting of 96 weight percent argon and four percent hydrogen gas, that is, hydrogen makes up about forty-three volume percent of the gas. The composition of the gas is not critical, but it is preferred that the hydrogen be less than about 5 weight percent, to avoid creating a flammable mixture. This hydrogen charging step, as it may be called, may be actually performed in the die itself, allowing the stock to absorb the hydrogen into the alloy matrix whie in the die chamber. Many charging cycles or conditions will yield the desired amount of hydrogen in the alloy; for example, heating in the described environment for two hours at 760° C. and at 150 psi pressure has been found to produce the desired transient alloy. In general, pressures of between about 50 to 300 psi or more may be used. Temperatures of between about 600°–760° C. may be used. The temperature also is not critical, but it is preferred to use temperatures in the lower part of the range, since the solubility of hydrogen in titanium decreases with increasing temperature. It is preferred to keep the temperature below that at which the grain size of the alloy grows, in any event.

After the desired transient alloy has been formed, that is, after sufficient hydrogen has been dissolved in the alloy matrix, the alloy may be formed into the desired shape. This procedure follows previous practice. Typically, the pressure is released on one side of the stock and the pressure on the other side of the stock is increased, causing the stock to flow into the die and assume the desired shape of the die. After forming, the original composition of the alloy is restored by driving the hydrogen out of the alloy matrix. Typically, this is done by heaating the formed part in a vacuum, or a partial vacuum, for example, for two hours at 650° C. The temperature of the restoration and other conditions are not critical. It is preferred that heating be at above about 600°–650° C., since at much lower temperatures the rate at which the hydrogen is released may be slow. Preferably the temperatures should be below the forming temperatures, to minimize changes in the grain structure of the alloy, or at least below the temperature at which substantial grain growth occurs.

The following illustrations demonstrate the improvement in superplastic forming which may be accomplished, using applicants' transient alloys, with titanium and titanium alloys.

As shown in FIG. 1, two duplex annealed disks of titanium alloy were superplastically formed in a special steel conicical die having a diameter of 2.15 inches and a depth of 1.8 inches. The disks were nominally 2¾ inch diameter and 0.1 inch in thickness. Both disks were of Ti-8Al-1Mo-1V initially. A transient alloy having the composition Ti-8Al-1Mo-1V-0.2H was formed from the disk shown on the right in FIG. 1. The alloy was formed in the die by charging the die with an atmosphere of 99 weight percent argon and one percent hydrogen under 150 psi pressure and at 760° C. The disk was held at these conditions for two hours prior to forming.

Both disks were formed in the die at 860° C. under a biaxial sample stress ($\sigma$) of 18.8 MPa (2.72 Ksi) for 1.3 hours ($\sigma = P \times / 2T$, where P is the applied gas pressure, X is the sample radius of curvature and T is the instantaneous sample thickness.) In FIG. 1 the conventional alloy is shown on the left; it would not conform to the die under the test conditions. The transient alloy, shown on the right in FIG. 1, conformed fully to the die to make a complete complex shape. The part formed from the transient alloy was restored to the original alloy composition by heating at 650° C. in a vacuum for five hours.

Examination of the formed part revealed that the basic microstructural composition of the original alloy was maintained and that no degrading changes had occurred in the structure and mechanical properties of the alloy.

Figure 2:
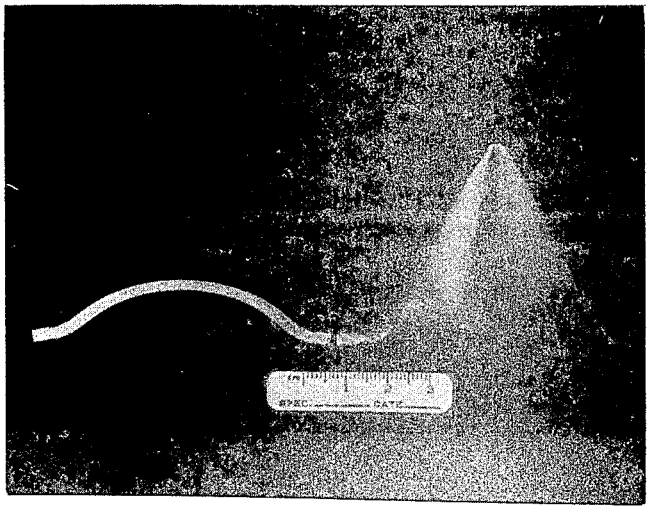
FIG. 2 is a comparison of Ti-6Al-2Sn-4Zr-2Mo conventional alloy superplastically formed in a cone die and applicants' Ti-6Al-2Sn-4Zr-2Mo-0.14H transient alloy superplastically formed in a cone die.

As shown in FIG. 2, two duplex annealed disks of titanium alloy were superplastically formed in a special steel conical die having a diameter of 2.15 inches and a depth of 1.8 inches. The disks were nominally 2¾ inch diameter and 0.1 inch in thickness. Both disks were of Ti-6Al-2Sn-4Zr-2Mo initially. A transient alloy having the composition Ti-6Al-2Sn-4Zr-2Mo-0.14H was formed from the disk shown on the right in FIG. 2. The alloy was formed in the die by charging the die with an atmosphere of 99 weight percent argon and one percent hydrogen under 150 psi pressure and at 760° C. The disk was held at these conditions for two hours prior to forming.

Both disks were formed in the die at 830° C. under a sample stress ($\sigma$) of 18.8 MPa (2.72 Ksi) for two hours ($\sigma = P \times / 2T$). In FIG. 2 the conventional alloy is shown on the left; it would not conform to the die under the test conditions. The transient alloy, shown on the right in FIG. 2, conformed fully to the die to make a complete complex shape. The part formed from the transient alloy was restored to the original alloy composition by heating at 650° C. in a vacuum for five hours.

Examination of the formed part revealed that the basic microstructural composition of the original alloy was maintained and that no degrading changes had occurred in the structure and mechanical properties of the alloy.

Figure 3:
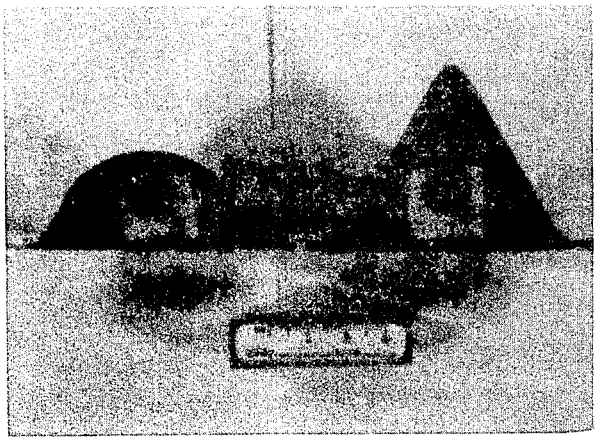
FIG. 3 is a comparison of a Ti-6Al-4V conventional alloy superplastically formed in a cone die and applicants' Ti-6Al-4V-0.11H transient alloy superplastically formed in a cone die.

As shown in FIG. 3, two duplex annealed disks of titanium alloy were superplastically formed in a special steel conical die having a diameter of 2.15 inches and a depth of 1.8 inches. The disks were nominally 2¾ inch diameter and 0.1 inch in thickness. Both disks were of Ti-6Al-4V initially. A transient alloy having the composition Ti-6Al-4V-0.11H was formed from the disk shown on the right in FIG. 3. The alloy was formed in the die by charging the die with an atmosphere of 99 weight percent argon and one percent hydrogen under 150 psi pressure and at 760° C. The disk was held at these conditions for two hours prior to forming.

Both disks were formed in the die at 900° C. under a sample stress ($\sigma$) of 18.8 MPa (2.72 Ksi) for two hours ($\sigma = P \times /2T$). In FIG. 3 the conventional alloy is shown on the left; it would not conform to the die under the test conditions. The transient alloy, shown on the right in FIG. 3, conformed fully to the die to make a complete complex shape. The part formed from the transient alloy was restored to the original alloy composition by heating at 650° C. in a vacuum for five hours.

Examination of the formed part revealed that the basic microstructural composition of the original alloy was maintained and that no degrading changes had occurred in the structure and mechanical properties of the alloy.

Figure 4:
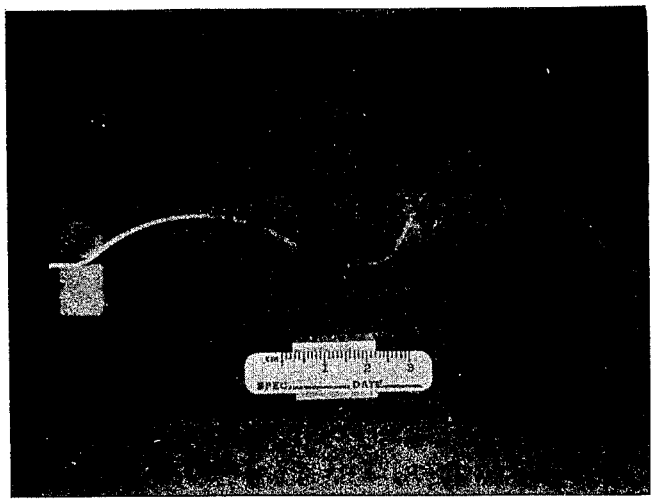
FIG. 4 is a comparison of unalloyed titanium superplastically formed in a cone die and applicants' Ti-0.22H transient alloy superplastically formed in a cone die.
Figure 5:
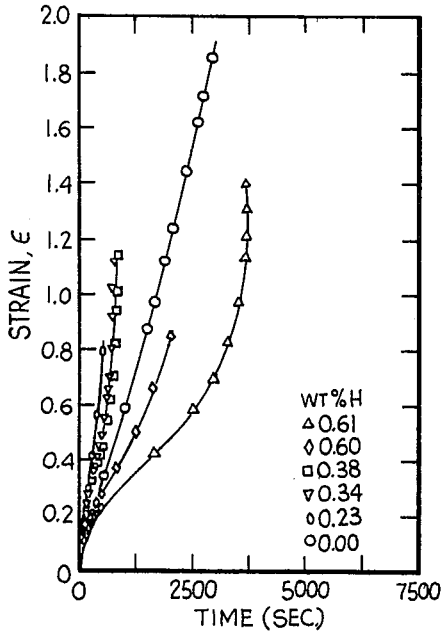
FIG. 5 is a comparison of Ti-6Al-4V transient alloy formed at 860° C.
Figure 6:
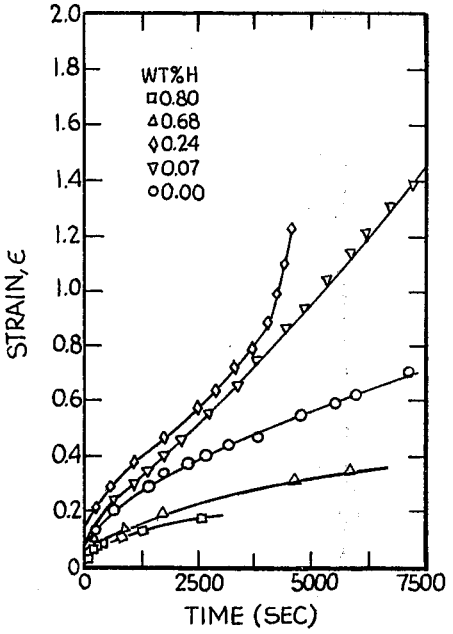
FIG. 6 is a comparison of Ti-6Al-4V transient alloy formed at 800° C.
Figure 7:
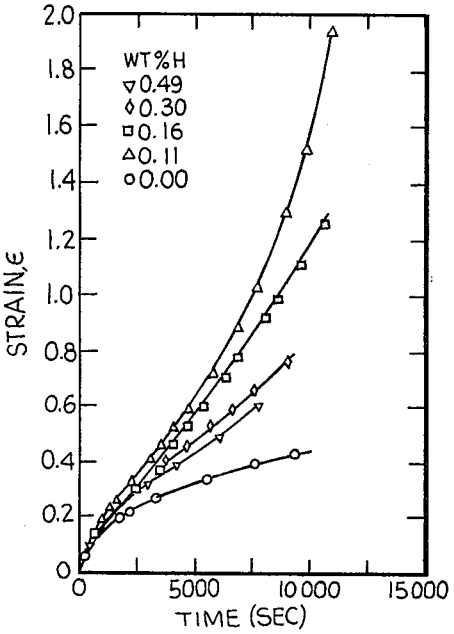
FIG. 7 is a comparison of Ti-6Al-4V transient alloy formed at 760° C.
Figure 8:
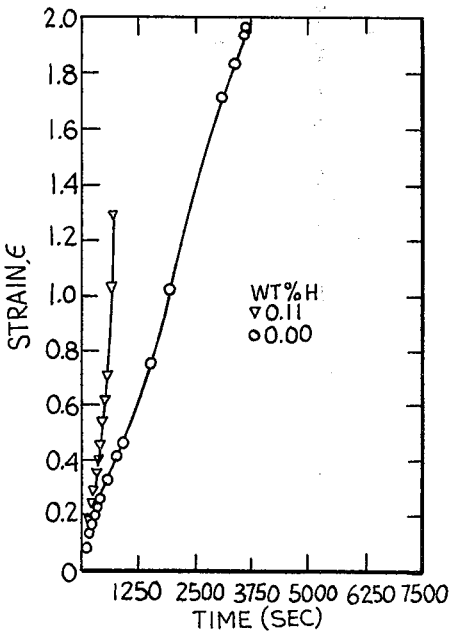
FIG. 8 is a comparison of Ti-6Al-2Sn-4Zr-2Mo transient alloy formed at 900° C.
Figure 9:
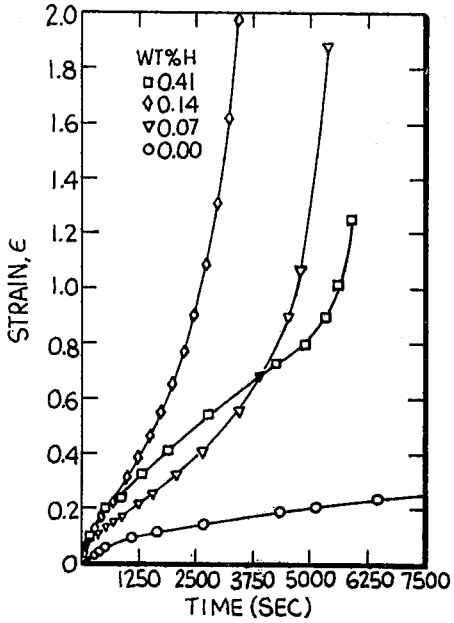
FIG. 9 is a comparison of Ti-6Al-2Sn-4Zr-2Mo formed at 830° C.
Figure 10:
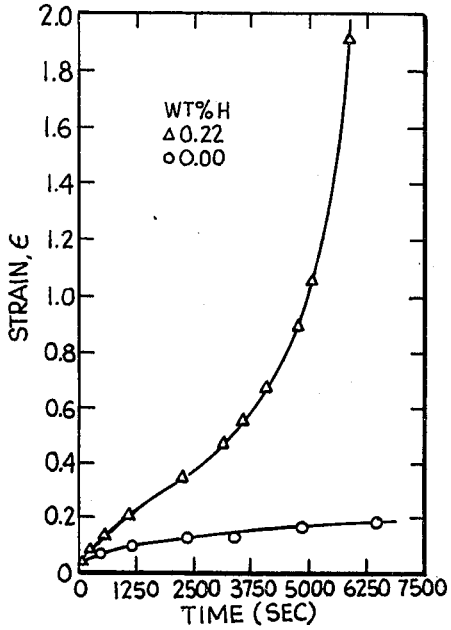
FIG. 10 is a comparison of Ti-6Al-2Sn-4Zr-2Mo transient alloy formed at 800° C.

As shown in FIG. 4, two disks of unalloyed titanium were superplastically formed in a special steel conical die having a diameter of 2.15 inches and a depth of 1.8 inches. The disks were nominally 2¾ inch diameter and 0.1 inch in thickness. Both disks were of unalloyed titanium initially. A transient alloy having the composition Ti-0.22H was formed from the disk shown on the right in FIG. 4. The alloy was formed in the die by charging the die with an atmosphere of 99 weight percent argon and one percent hydrogen under 150 psi pressure and at 760° C. The disk was held at these conditions for two hours prior to forming.

Both disks were formed in the die at 700° C. under a sample stress ($\sigma$) of 9.4 MPa (1.36 Ksi) for 40 minutes ($\sigma = P \times /2T$). In FIG. 4 the conventional alloy is shown on the left; it would not conform to the die under the test conditions. The transient alloy, shown on the right in FIG. 4, conformed fully to the die to make a complete complex shape. The part formed from the transient alloy was restored to the original alloy composition by heating at 650° C. in a vacuum for five hours.

Examination of the formed part revealed that the basic microstructural composition of the original alloy was maintained and that no degrading changes had occurred in the structure and mechanical properties of the alloy.

FIGS. 5–10 report the results of superplastic forming tests of various transient titanium alloys under differing conditions of temperature and sample strain $\epsilon$, where $$\epsilon = 0.30 - \ln\left[\frac{L - Q_2}{L - Q_1}\right]$$

$L$ = depth of cone die.

L=depth of cone die.

$Q_1$=depth of forming metal cone when contact is first made between forming metal and the die surface.

$Q_2$=instantaneous depth of forming metal cone.

Applicants' transient alloys allow the rapid and economical formation of complex shapes from titanium and titanium alloys by superplastic forming. The formed parts are light and strong; the structural integrity of the alloys is retained in forming. Applicants' technique is valuable and useful for all titanium alloys and has additional value when used with unalloyed titanium and high temperature titanium alloys (the near alpha alloys and the like), since it allows formation of complex shapes from these alloys by superplastic forming, which could not otherwise be formed by this method, or which, if formed would have a weakened structure.

It will be apparent to those skilled in the art that many variations and departures from the specific alloys described herein may be made without departing from the spirit and essential characteristics of the invention. The specific embodiments are to be considered in all their aspects and are for purposes of illustration and are not restrictive of the scope of the invention. The scope of the invention herein is to be determined by the claims which are appended hereto and their equivalents.

We claim:

1. The method of superplastically forming of titanium and titanium alloys comprising treating a stock piece of titanium or titanium alloy in a hydrogen containing atmosphere causing absorption of hydrogen into the matrix of the stock part in an amount effective to improve forming, and forming the treated stock in a die.

2. The method of claim 1 wherein the hydrogen is present between about 0.01 to 0.5 weight percent.

3. The alloy of claim 1 wherein the method has the formula A—XH where A is selected from the group consisting of titanium and titanium alloys, where H is hydrogen and where X is a value of between about 0.01 to 0.5 weight percent.

4. The method of claim 3 wherein the titanium alloy is selected from the group consisting of Ti-8Al-1Mo-1V, Ti-5Al-2.5Sn, Ti-6Al-V and Ti-6Al-2Sn-4Zr-2Mo alloys.

5. The method of claim 3 wherein the titanium alloy is selected from the group consisting of high temperature and near alpha titanium alloys.

6. The method of claim 1 wherein the treated stock is in sheet form of between about 0.040 and 3/16 inches thickness.

7. The method of claim 1 including removing the hydrogen from the formed stock.

8. The method of claim 7 wherein the formed stock is heated in at least a partial vacuum to remove the hydrogen therefrom.

9. The method of claim 9 wherein the formed stock is heated at a temperature of between about 600°–650° C.

10. The method of claim 1 wherein the stock is treated under elevated temperature and pressure in the hydrogen containing atmosphere.

11. The method of claim 10 wherein the stock is treated at a temperature of between about 600°–760° C. and at a pressure of at least about 50–300 psi.

12. The method of claim 10 wherein the stock is treated in an atmosphere containing up to about 5% hydrogen.

13. The method of superplastically forming titanium and titanium alloy sheets to form complex parts comprising introducing a sheet of titanium or titanium alloy into a die, introducing a hydrogen containing atmosphere into the die at an elevated temperature and an elevated pressure, adsorbing hydrogen into the titanium or titanium alloy sheet to form a transient alloy containing hydrogen, the hydrogen being absorbed into the alloy matrix in an amount effective to improve superplastic forming of the sheet, releasing the pressure on one side of the titanium or titanium alloy sheet and increasing the pressure on the remaining side of the sheet causing the sheet to flow into and conform to the shape of the die and restoring the titanium or titanium alloy sheet to its original composition under temperature conditions effective to maintain the ductility of the original titanium or titanium alloy sheet.

14. The method of claim 13 wherein hydrogen is absorbed into the sheet at a level of between about 0.01 and 0.5 weight percent.

15. The method of claim 13 wherein the transient hydrogen containing alloy formed contains hydrogen in an amount less than that capable of producing a single beta phase alloy.

16. The method of claim 13 wherein the grain size of the titanium or titanium alloy formed part is maintained below about 10 microns.

17. The method of claim 13 wherein the titanium or titanium alloy sheet is restored to its original composition at a temperature below that at which substantial grain coarsening occurs.

18. A titanium or titanium alloy formed part, the part being superplastically formed by the method of claim 15, the formed part being of a sheet stock between about 0.040 and 3/16 inch thickness, the as formed part substantially retaining the ductility and strength of the original titanium or titanium alloy sheet stock used in forming the part, the as formed part having a grain size of below about 10 microns.

19. The method of superplastically forming titanium and titanium alloy sheets to form complex parts comprising introducing a sheet of titanium or titanium alloy into a die, the sheet being between about 0.040 and 3/16 inches in thickness, introducing a hydrogen containing atmosphere into the die at an elevated temperature of between about 600°–760° C. and an elevated pressure of at least about 50–300 psi, absorbing hydrogen into the titanium or titanium alloy sheet to form a transient alloy containing hydrogen, the hydrogen being absorbed into the alloy matrix in an amount between about 0.01 and 0.5 weight percent less than an amount producing a single phase alloy and being effective to improve superplastic forming of the sheet, releasing the pressure on one side of the titanium or titanium alloy sheet and increasing the pressure on the remaining side of the sheet causing the sheet to flow into and conform to the shape of the die and restoring the titanium or titanium alloy sheet to its original composition while maintaining the strength and ductility of the original titanium or titanium alloy sheet, including heating the formed sheet at a temperature of between about 600°–650° C., the method being effective to increase the speed of superplastic forming of the titaium or titanium alloy sheet and reduce the wear on the die in which the titanium or titanium alloy sheet is formed.

20. The method of claim 19 wherein the grain size of the titanium or titanium alloy formed sheet is maintained below about 10 microns.

21. The method of claim 19 wherein the titanium or titanium alloy is treated in an atmosphere containing up to about 5% hydrogen and wherein the formed sheet is heated in at least a partial vacuum to remove the hydrogen therefrom.

* * * * *